US009102468B2

(12) United States Patent
Goedken et al.

(10) Patent No.: US 9,102,468 B2
(45) Date of Patent: Aug. 11, 2015

(54) MECHANISM TO EMPTY TRUNNION EQUIPPED REFUSE CONTAINER INTO SIDE LOADING COLLECTION BODY

(75) Inventors: Kenneth D. Goedken, Dubuque, IA (US); Jared L. Rowland, Dyersville, IA (US); Marlin L. Johnson, Guttenberg, IA (US); Roger Taake, Elkader, IA (US)

(73) Assignee: Kann Manufacturing Corporation, Guttenberg, IA (US)

( * ) Notice: Subject to any disclaimer, the term of this patent is extended or adjusted under 35 U.S.C. 154(b) by 65 days.

(21) Appl. No.: 13/554,334

(22) Filed: Jul. 20, 2012

(65) Prior Publication Data

US 2013/0022431 A1 Jan. 24, 2013

Related U.S. Application Data

(60) Provisional application No. 61/510,339, filed on Jul. 21, 2011, provisional application No. 61/638,601, filed on Apr. 26, 2012.

(51) Int. Cl.

| | |
|---|---|
| ***B65F 3/08*** | (2006.01) |
| *B65F 3/20* | (2006.01) |
| *B65F 3/28* | (2006.01) |
| *B65F 3/02* | (2006.01) |

(52) U.S. Cl.

CPC ... *B65F 3/08* (2013.01); *B65F 3/20* (2013.01); *B65F 3/28* (2013.01); *B65F 2003/0243* (2013.01); *B65F 2003/0276* (2013.01)

(58) Field of Classification Search

USPC ..... 414/406, 408, 409, 421

See application file for complete search history.

(56) References Cited

U.S. PATENT DOCUMENTS

| | | | | |
|---|---|---|---|---|
| 3,679,077 | A * | 7/1972 | Gennick | 414/303 |
| 3,702,662 | A * | 11/1972 | Davieau | 414/303 |
| 4,227,849 | A | 10/1980 | Worthington | |
| 4,741,658 | A | 5/1988 | Zelinka et al. | |
| 5,425,613 | A * | 6/1995 | Osborn | 414/408 |
| 5,720,588 | A * | 2/1998 | Graves | 414/406 |
| 6,027,299 | A | 2/2000 | Williams | |
| 6,224,317 | B1 | 5/2001 | Kann et al. | |
| 6,261,046 | B1 * | 7/2001 | Fryman | 414/410 |
| 6,929,441 | B2 * | 8/2005 | Arrez et al. | 414/408 |
| 7,390,159 | B2 * | 6/2008 | Rimsa et al. | 414/408 |

(Continued)

OTHER PUBLICATIONS

International Search Report dated Jan. 28, 2013 for co-pending PCT application.

(Continued)

*Primary Examiner* — Kaitlin Joerger

(74) *Attorney, Agent, or Firm* — Brett D. Papendick; Shuttleworth & Ingersoll, PLC

(57) ABSTRACT

An automated side loading mechanism for a refuse collection body capable of lifting and emptying a refuse container equipped with a trunnion bar. A carriage reaches out from the side of the collection body and includes a lift mechanism. The lift mechanism includes pockets to receive opposing ends of the trunnion bar on the refuse container. Lock arms pivot downward so that bar members on the lock arms overlie top edges of the refuse container. The carriage is retracted and the lift mechanism is raised on the carriage so that the refuse container can be upended over the load opening of the collection body. The bars on the lock arms angle upwardly to allow plastic lids hinged to the refuse container to swing past the bars when the container is upended, while restraining the container from falling into the collection body.

14 Claims, 12 Drawing Sheets

(56) References Cited

U.S. PATENT DOCUMENTS

| | | | | |
|---|---|---|---|---|
| 7,871,233 | B2 * | 1/2011 | Arrez et al. | 414/408 |
| 2003/0099529 | A1 | 5/2003 | Arrez et al. | |

OTHER PUBLICATIONS

Website video: http://www.youtube.com/watch?v=GlbVmK-sGFQ &feature=channel&list=UL.

Website video: http://www.youtube.com/watch?v=tH1iiVpS9Bs &feature=channel&list=UL.

Website video: http://www.youtube.com/watch?v=gcTCcBBK8Do &feature=channel&list=UL.

Website video: http://www.youtube.com/watch?v=SqcSI497_CM &feature=channel&list=UL.

* cited by examiner

MECHANISM TO EMPTY TRUNNION EQUIPPED REFUSE CONTAINER INTO SIDE LOADING COLLECTION BODY

CROSS REFERENCE TO RELATED APPLICATIONS

This application claims priority under 35 USC §119 from copending provisional patent application entitled ADAPTER TO EMPTY REAR LOADING REFUSE CONTAINER INTO AUTOMATED SIDE LOADING COLLECTION BODY, Ser. No. 61/510,339, filed Jul. 21, 2011 and from copending provisional patent application entitled MECHANISM TO EMPTY TRUNNION EQUIPPED REFUSE CONTAINER INTO SIDE LOADING COLLECTION BODY, Ser. No. 61/638,601, filed Apr. 26, 2012. The disclosures of provisional patent application Ser. No. 61/510,339 and provisional patent application Ser. No. 61/638,601 are hereby incorporated in their entireties.

BACKGROUND

Refuse, recycling and green waste commodity may be placed in any one of a variety of different waste containers. Conventionally, these containers range in volume between one cubic yard and ten cubic yards and can normally be categorized as either being designed for collection by a front end loader (FEL), side loader (SL) or rear end loader (REL) style truck. Since the application and methods of collection are considerably different among these styled units, the containers for each of these trucks are normally mutually exclusive.

FEL waste containers generally include channels or fork pockets built into the sides of the waste container. The collection of commodity from FEL waste containers has typically required a specialized commodity collection vehicle having a pair of spaced forks supported by a pair of lifting arms. To engage and unload the FEL container, the forks must be inserted into the channels and the lift arms must be actuated to lift and invert the FEL container over an opening communicating with an interior storage compartment of the vehicle.

The collection of commodity from SL containers requires a specialized collection vehicle having a pocketed assembly mounted to a lift carriage. To engage and lift the SL container, the pocketed assembly is positioned into a specialized hooked plate configuration attached to the SL container and the lift carriage is actuated to lift the SL container over an opening communicating with an interior storage compartment of the vehicle.

To load commodity from REL containers requires a specialized collection vehicle having a lower back end configured to engage each end of a trunnion on the container and having a cable at the rear of the vehicle configured to be connected to a top rear portion of the REL container. A motorized winch on the vehicle is then used to pull and lift the REL container off of the ground while the body of the REL container pivots about the trunnion and empties its contents into the rear of the vehicle. In lieu of the winch and cable, some commodity collection vehicles utilize a hydraulic lifting apparatus configured to move the container about the trunnion into a dumping position.

Since the applications and the methods of collection between FEL, RL and REL trucks are so different, the designs of waste containers to be collected by the different style trucks are normally mutually exclusive. As a result, waste hauling companies are forced to maintain a larger inventory of varying types of collection vehicles and an equally large inventory of varying types of containers making it expensive and inconvenient. Further, the modification of containers to fit the collection mechanisms of other specialized collection vehicles is also expensive and inconvenient. Therefore, there is a continuing economic need to find ways to make these specialized commodity collection vehicles more route flexible by enabling them to unload commodity from the normally mutually exclusive containers, wherever possible.

SUMMARY OF THE INVENTION

The present invention provides a refuse collection body to be carried on a truck chassis, the collection body being equipped with an automated side loading mechanism for automated dumping of rear end loading (REL) refuse containers. The automated side loading mechanism is capable of lifting and emptying a refuse container equipped with a trunnion bar extending from both ends of the container, this type of refuse container designed to be unloaded into a rear trough on a rear loading refuse collection body. With this mechanism, a side loading refuse collection truck can pass down a street or alley and unload rear end loading refuse containers situated at the sides of the roadway. In addition, the mechanism includes grappling arms which can grasp smaller upright containers and empty them into the load opening of the collection body.

The side loading mechanism may be provided with an adapter which is removable from the container lifting mechanism. The adapter therefore can be easily attached to the lift mechanism of the side loading refuse body after removal of side load container connection structure on a conventional side loading refuse collection body. Therefore the same refuse collection truck can be used to collect side loading containers on one trip, and be easily converted to collect rear end load containers on another trip.

The collection body is equipped with a carriage which can reach out from the side of the collection truck and attach to a rear end loading refuse container to be unloaded, pull the refuse container to the side of the refuse collection body, and unload the container by upending it over the load opening of the collection body. The carriage carries a lift mechanism which includes trunnions receiver, arms which have open topped pockets to receive opposing ends of the trunnion bar on the refuse container. Pivotable arms on the lift mechanism can be pivoted downward to overlie top edges of the refuse container and retain the ends of the trunnion bar in the pockets. A stabilizer plate abuts the front wall of the container as it is lifted. The pivotable arms include bars which extend inwardly over the top edges of the refuse container. After the lift mechanism attaches to the refuse container, the carriage is retracted to the side of the collection body and the lift mechanism is raised along the carriage so that the refuse container can be upended over the load opening of the collection body. The bars on the pivotable arms angle upwardly to allow plastic lids hinged to the refuse container to swing past the bars when the container is upended, while restraining the container from falling into the collection body, or rotating too far about the trunnions. After the refuse container is unloaded, the lift mechanism lowers the refuse container to street level and returns the container to the position at the side of the street or alley where it was originally located and then detaches from the container.

The lift mechanism includes the adapter which can be quickly removed so that the lift mechanism can be converted to being capable of attaching to refuse containers designed to be emptied by traditional side loading refuse collection bodies, such side loading refuse containers having hooks along the sides of the containers.

The pivot arms, stabilizer and lift mechanism are all operated by hydraulic cylinders, as is the carriage on which they are carried.

The attachment mechanism includes a frame which supports trunnion receiving pockets which are spaced apart appropriately to receive the trunnion bar extensions extending from the ends of the trunnion-equipped refuse container. The pivotable arms are hinged to the frame and selectively lower from a raised position to a lowered position over the tops of the end walls of the container. The pivotable arms include bar members extending inwardly toward each other so that they overlie the tops of the end walls of the container when the pivotable arms are lowered. The bar members incline upward from the pivotable arms when the pivotable arms are lowered, so that when the refuse container is upended, a flexible plastic lid hinged on the container will fall past the ends of the bar members while the bar members restrain the container from falling into the load opening of the collection body.

It is a primary object of the invention to provide a versatile refuse collection body which can unload rear end load style containers commonly in use, while doing so in narrow roadways and alleys.

It is a further object of the invention to provide an adapter which can convert a side loading refuse collection body to permit the side loading mechanism to engage and empty rear end load style refuse containers which are equipped with trunnion bars.

It is a further object of the invention to provide an automated commodity collection body which can attach to REL containers along roadways, pull them alongside the collection body, and empty the REL container into the collection body without any handling of the REL container by an operator of the collection truck on which the refuse collection body is mounted.

DETAILED DESCRIPTION

Figures 1, 2:
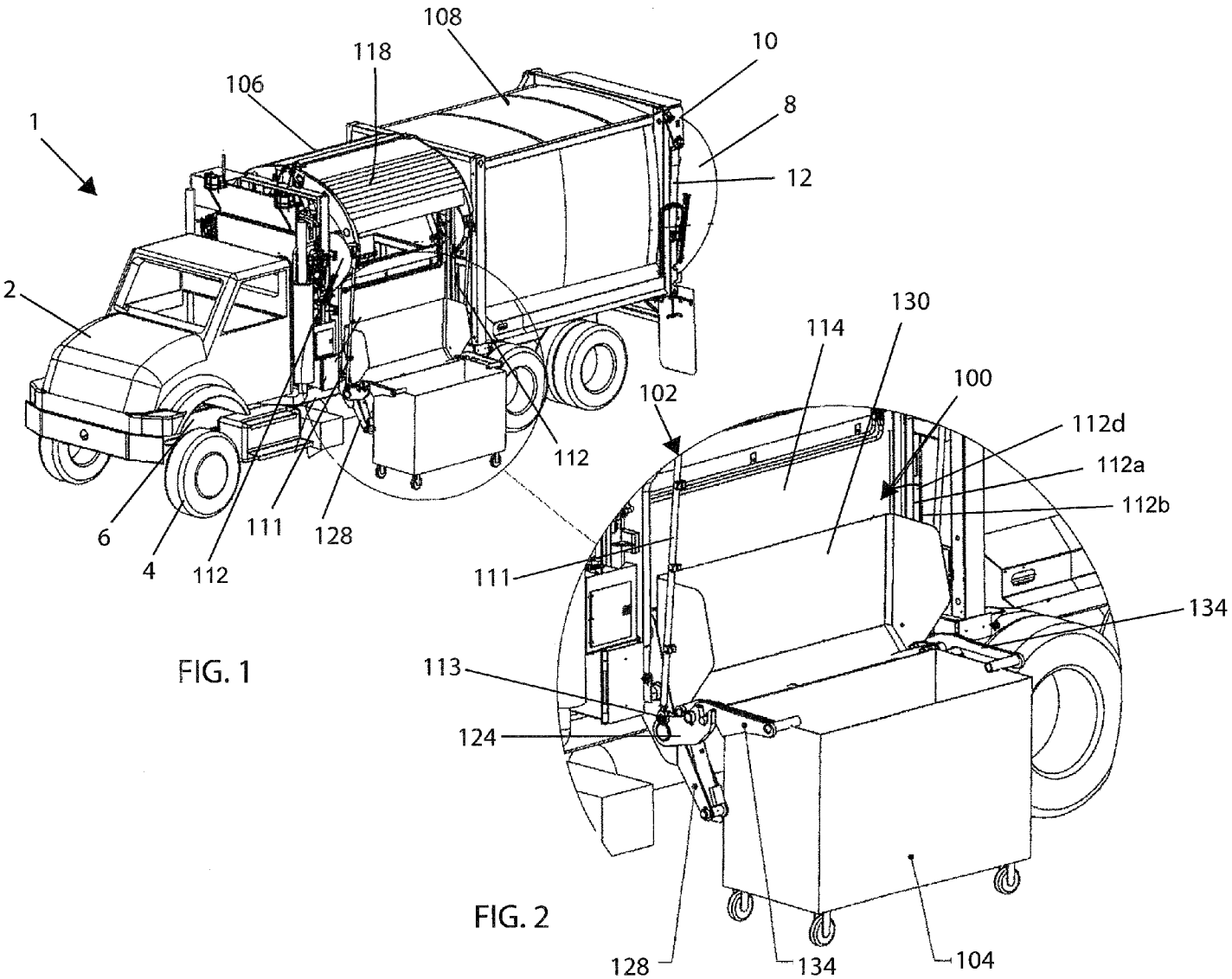
FIG.1 is a perspective view of a first embodiment adapter of the present invention mounted on a side load refuse hauling vehicle showing the adapter clamped on a rear end loading container.
FIG. 2 is an enlarged perspective of the adapter of FIG. 1.
Figure 3:
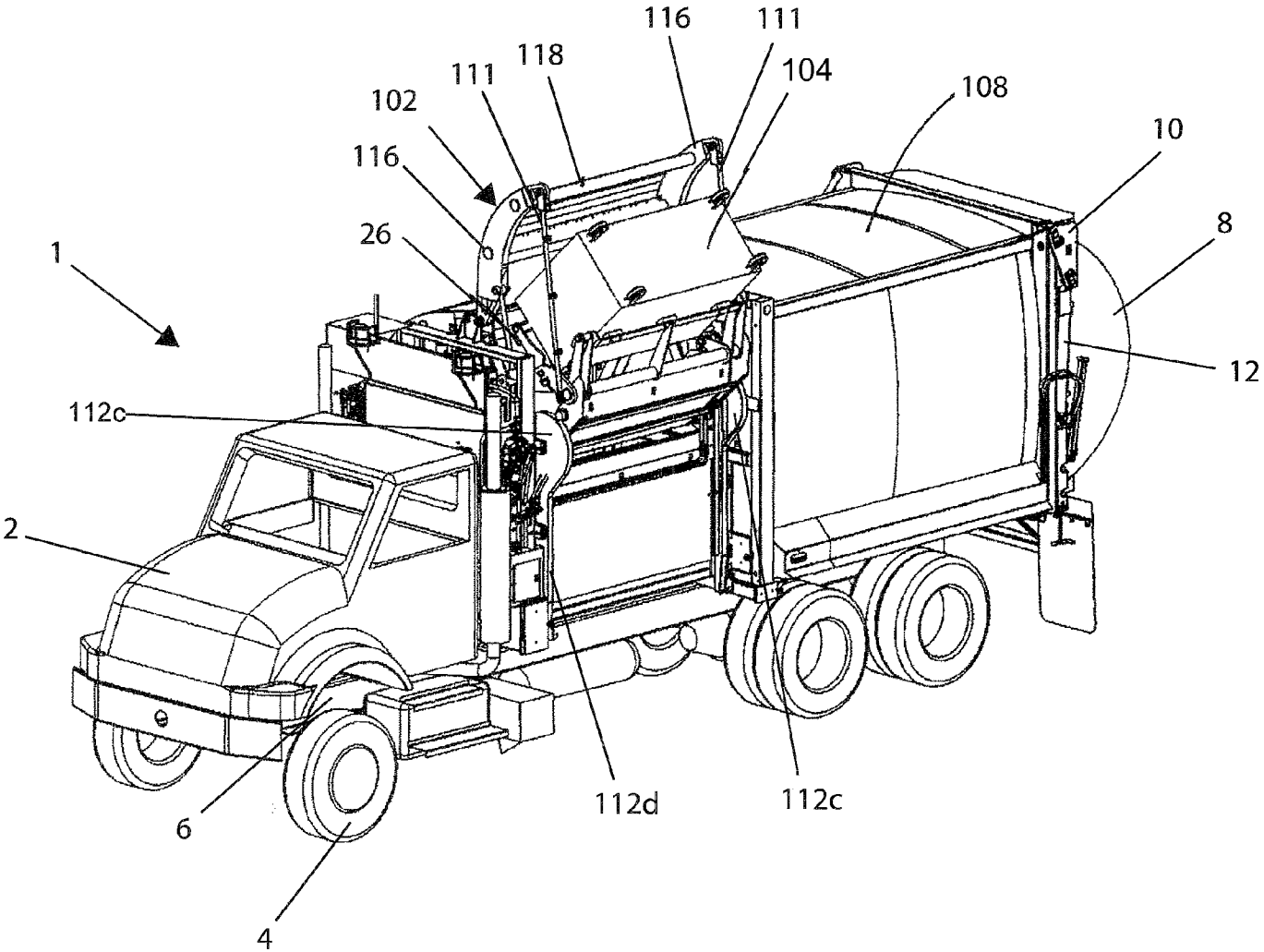
FIG. 3 is a perspective view of the first embodiment adapter combined with the side load refuse hauling vehicle with the container shown in the inverted unloading position.
Figure 5:
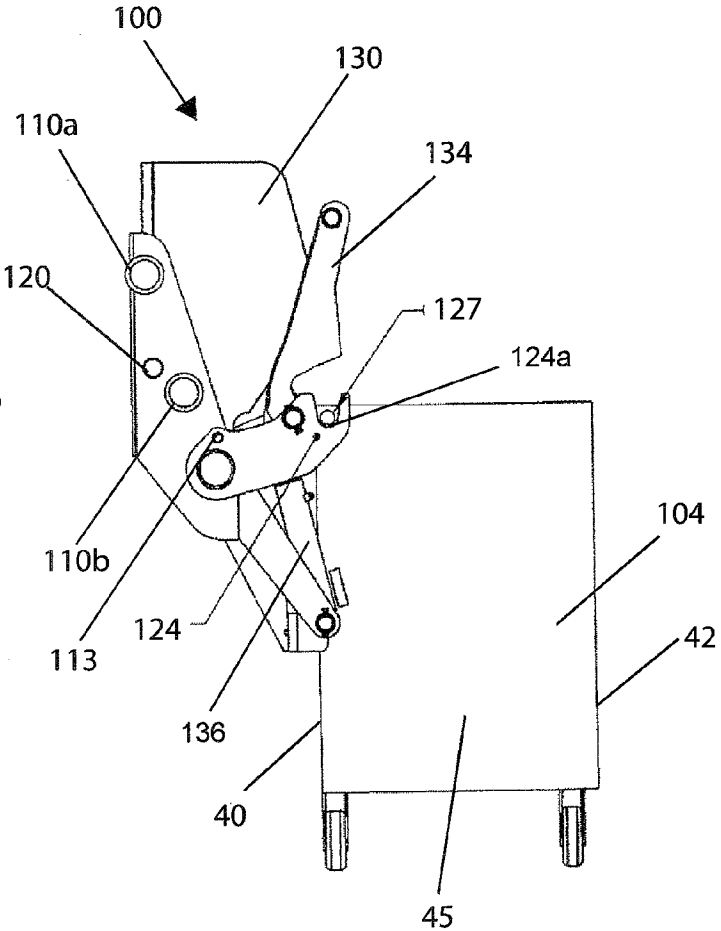
FIG. 5 is a side view of the adapter and container of FIG. 4.

FIGS. 1-3 depict an automated side loading refuse collection vehicle 1, including an adapter 100 to enable a lift mechanism 102 to attach and lift a rear end load refuse container 104. As described below, container 104 may be attached to lifting mechanism 102 and commodity disposed therein can be emptied into a corresponding compaction chamber 106 of collection vehicle 1. Compaction blades within compaction chamber 106 compact the commodity and drive it into a storage compartment 108 of collection vehicle 1.

As can be understood from reference to FIGS. 4-7, a rear end loading container such as rear end loading container 104 includes front wall 40 and rear wall 42 joined by shorter end walls 44, 45. Rear end loading refuse container 104 also includes trunnions 126, 127 which extend laterally from opposing end walls 44, 45 of the container 104. Trunnions 126, 127 are located near top 41 of front wall 40 and are typically coaxial. Each trunnion 126, 127 is receivable within a trunnion pocket 124*a* of one trunnion pocket member 124. With trunnions 126, 127 cradled within trunnion pockets 124*a*, lock arms 134 (or alternatively stop arms 135, see FIGS. 11-13) may be rotated into their lowered position a small distance above or in contact with top edges 46, 47 of end walls 44, 45 of container 104. Lock arms 134 and stop arms 135 may be driven independently, or they may operate simultaneously.

Refuse collection vehicle 1 includes a conventional cab 2 and wheels 4 connected to and supported on a chassis or frame 6 which carries storage compartment 108 and compaction chamber 106. A tailgate 8 is pivotally attached to the top of storage compartment 108 by vertically displaceable hinges 10 at the rear of refuse collection vehicle 1. Tailgate lift cylinders 12 are pivotally attached to tailgate 8 and to storage compartment 108. To unload refuse collection vehicle 1, tailgate lift cylinders 12 are extended to vertically displace and pivot or swing tailgate 8 to an open position, and the commodity may be expelled out of storage compartment 108.

As shown in FIGS. 1-3, container 104 may selectively attach to lift mechanism 102 by way of adapter 100. Attached container 104 is raised from a lowered position with container 104 on the ground to an inverted raised position above load opening 26 of compaction chamber 106 of collection vehicle 1 for unloading the commodity.

Figure 1A:
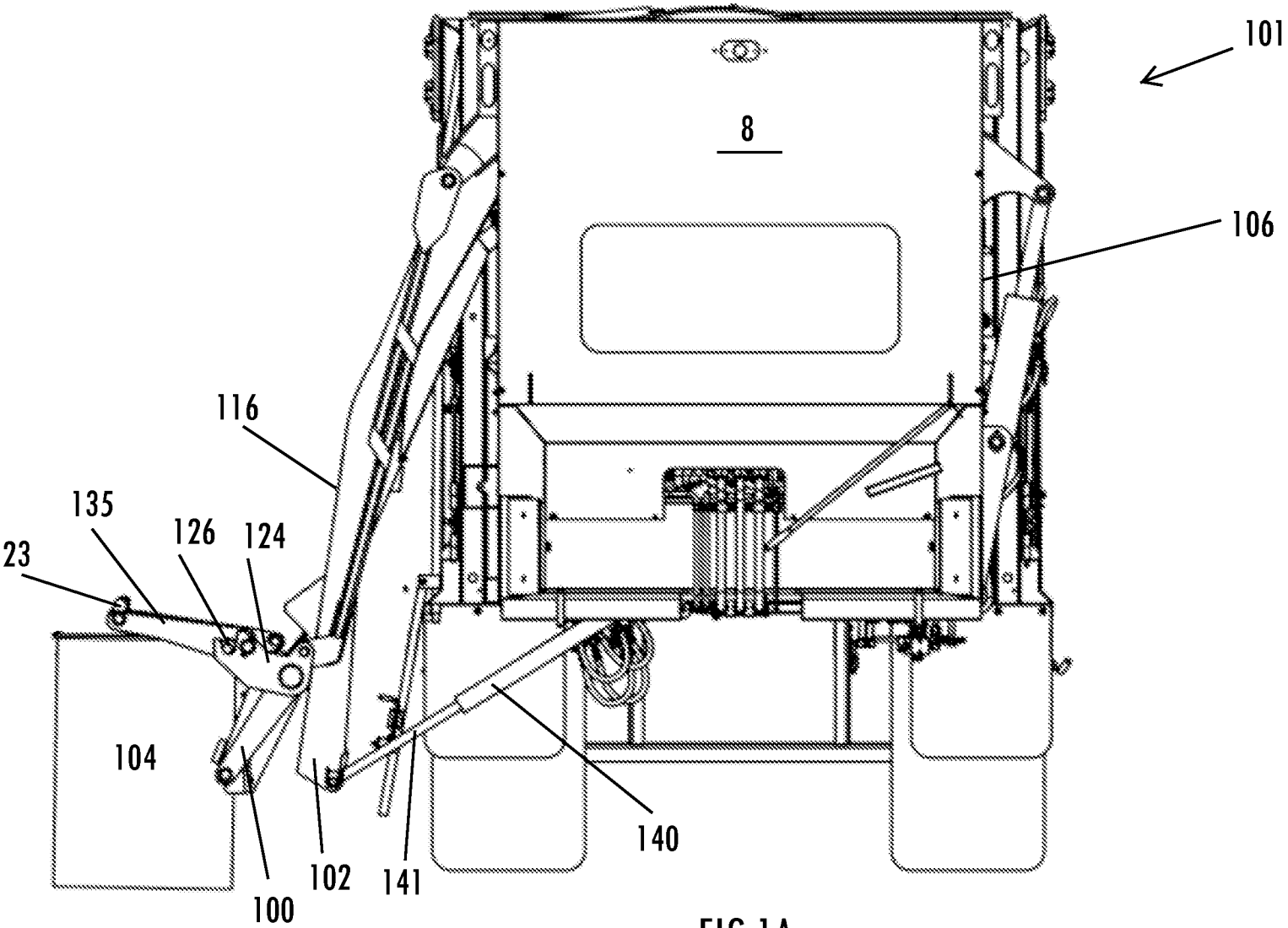
FIG. 1A is a front-end view of an automated side load refuse body showing the first embodiment adapter of the present invention mounted to a lift mechanism extended out and attached to a rear end loading container.

As shown in FIG. 1A, a driver 140, which is a pair of hydraulic cylinders 140 in this illustrative embodiment, can move adapter 100 outward from refuse collection body 101 to container 104 to automate the attachment process. Each cylinder 140 is positioned underneath collection body 101 with a rod 141 combined to lift mechanism 102. Upper end of lift arms 116 are pivotally attached to pivot outward from collection body 101 to reach container 104. When a vehicle carrying collection body 101 pulls up next to container 104, each cylinder 140 actuates and rod 141 extends outward to move adapter 100 toward container 104 to a point where trunnion pocket members 124 are aligned below trunnions 126, 127 of container 104. Lift mechanism 102 lifts container 104 by trunnions 126, 127. Rod 141 of cylinder 140 retracts to pull lift arms 116 inward to position container 104 to the side of collection body 101. This allows the operator to collect and empty container 104 without leaving the cab 2 of the refuse collection vehicle transporting refuse collection body 101.

Referring additionally to FIGS. 4-10, adapter 100 comprises a frame 103 which supports spaced apart trunnion pocket members 124. The trunnion pocket members 124 include open topped trunnion pockets 124*a* into which trunnions 127 of a container 104 may be received. The frame 103 also supports pivotable lock arms 134 which are hinged to frame 103 and each lock arm 134 is movable between a raised position and a lowered position and operated selectively by hydraulic cylinder drivers. The lock arms 134 are arranged to generally overlie the trunnion pocket members 124 but are slightly inboard of pocket members 124 relative to the space between trunnion pocket members 124. Each lock arm 134 includes a bar member 22 extending inwardly from the lock arm 134 toward the bar member 22 on the other lock arm 134. A stabilizer 128 is also supported on the frame 103 such that stabilizer 128 will abut the front wall 44 of a trunnion-equipped refuse container such as container 104 to prevent container 104 from rotating toward its front wall 44 about its trunnions 127.

Lift mechanism 102 lifts adapter 100 along tracks 112 thereon which may be pivotally attached to a side wall 114 of compaction chamber 106 of collection body 101. Referring again to FIGS. 1-3, lift mechanism 102 includes lift rods 111 attachable to adapter 100 at a receptacle 113. Receptacle 113 may be a hole in a trunnion pocket member I 24 to receive a bolt for combining lift rods 111 to trunnion pocket member 124. Carriage track rollers 110*a*, 110*b*, positioned on opposing sides of adapter 100, engage and follow spaced apart tracks 112 as adapter 100 is lifted along tracks 112 between positions. Lift rods 111 are pivotally attached at their ends to corresponding lift arms 116. A compaction chamber cover 118 extends between corresponding lift arms 116 to cover compaction chamber 106. A lift cylinder (not shown) anchored to collection body 101 engages each lift arm 116 to automatically raise and lower lift mechanism 102 between the lowered and raised positions. When lift arms 116 elevate, compaction chamber cover 118 rises from its rest position overlying the load opening 26 of compaction chamber 106.

In the illustrated embodiment of FIGS. 1-3, each lift cylinder is extended when lift mechanism 102 is in the lowered position. In the lowered position, compaction chamber cover 1.18 and attached lift arms 116 are substantially horizontal, with compaction chamber cover 118 overlying the load opening 26 of compaction chamber 106. As the cylinder retracts, lift arms 116 pivot upward and pull lift rods 111 which draw adapter 100 to the raised position.

Figure 4:
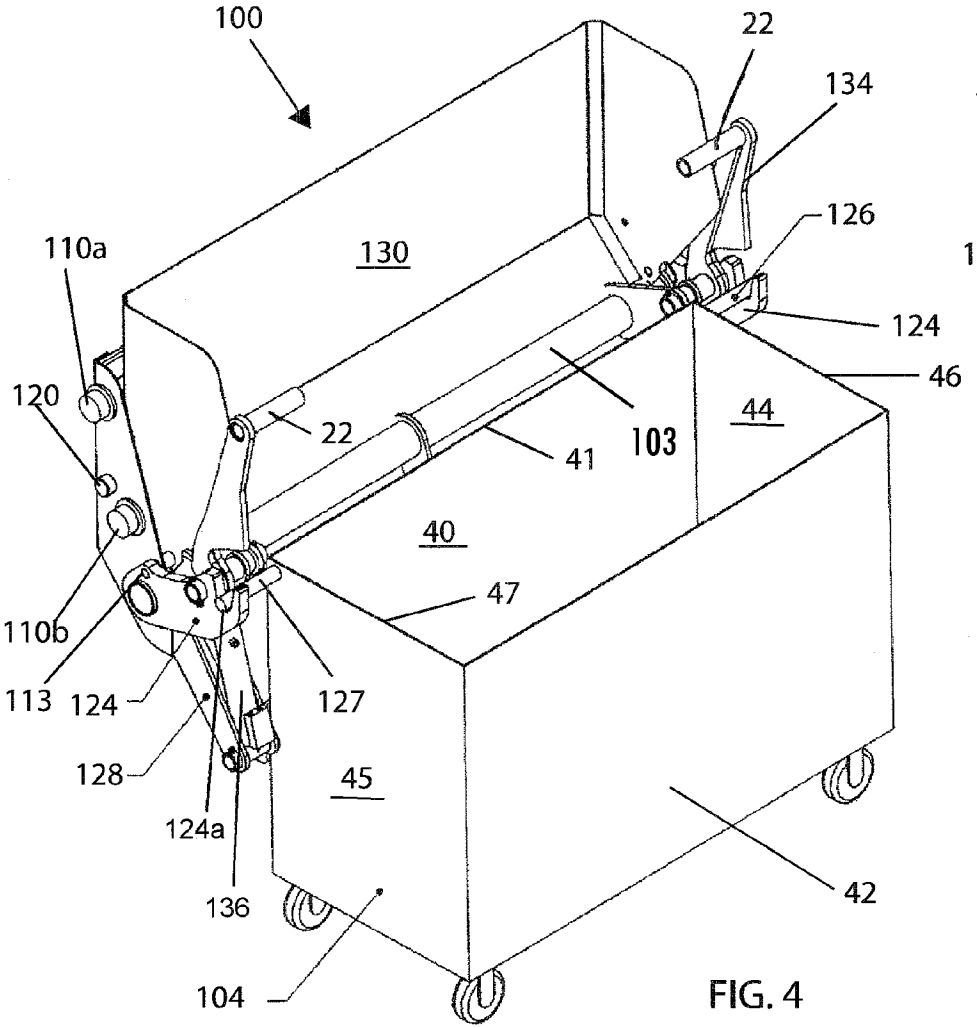
FIG. 4 is a perspective view of the first embodiment adapter of the present invention showing a rear end load container detachably connected to the adapter.

Referring specifically to FIG. 4, as well as to FIGS. 1-3, two pairs of carriage track rollers 110*a*, 110*b* are positioned on each side of adapter 100 and align with a pair of rails 112*a*, 112*b* that form each track 112. Carriage track rollers 110*a*, 110*b* are spaced apart such that carriage track roller 110*a* rides against rail 112*a* inside track 112. Carriage track roller 110*b* rides against rail 112*b* on the outside of track 112. At an upper curved portion 112*c* of track 112, carriage track rollers 110*a* move away from rail 112*a*. An idler roller 120 is positioned apart from carriage track rollers 110*a*, 100*b* to guide adapter 110 in its transition between a lower portion 112*d* and upper portion 112*c* of track 112. Upper portion 112*c* of each track 112 is angled away from compaction chamber 106 and curved at its upper end to guide container 104 in an arcuate path to an inverted unloading position.

In the lowered position, container 104 is positioned alongside side wall 114 of vehicle 1. Adapter 100 combined with lift mechanism 102 lifts container 104 off the ground. Carriage track rollers 110*a*, 110*b* are positioned against respective rails 112*a*, 112*b* of tracks 112 and guide adapter 100 upward. At upper portions 112*c* of tracks 112-each carriage track roller 110*a* moves away from rail 112*a* of track 112 and each idler roller 120 moves against the inside of rails 112*b* of tracks 112 to prevent adapter 100 from moving backward and forward. Upper portion 112*c* of each track 112 guides adapter 100 outward in the arcuate path and tips container 104 to its upward inverted position, as shown in FIG. 3.

Figure 8:
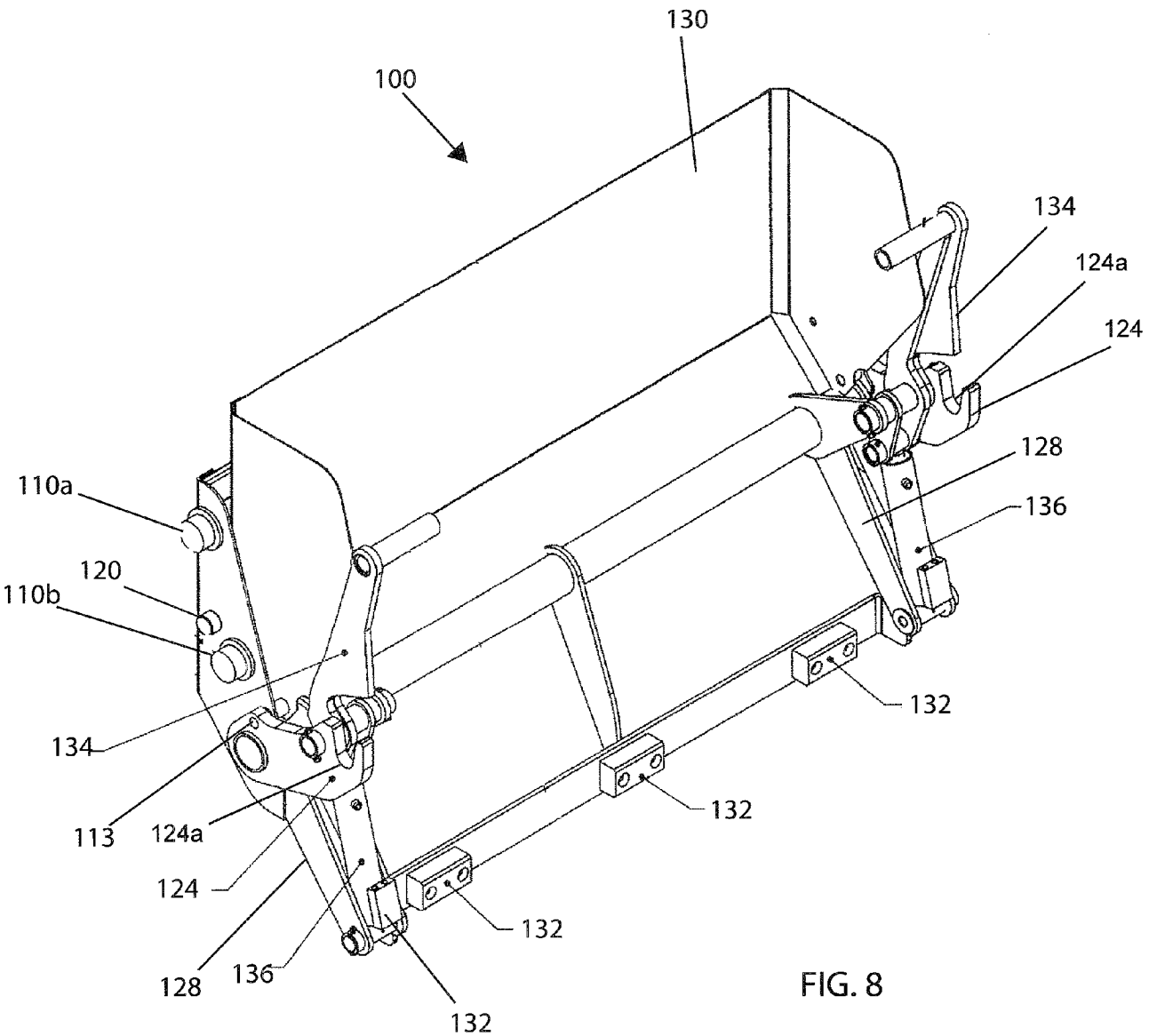
FIG. 8 is a perspective view of the first embodiment adapter of the present invention.
Figure 10:
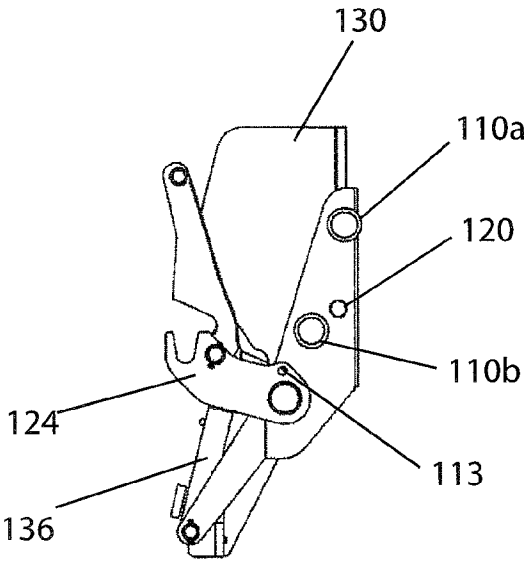
FIG. 10 is a side view of the adapter of FIG. 9.
Figure 9:
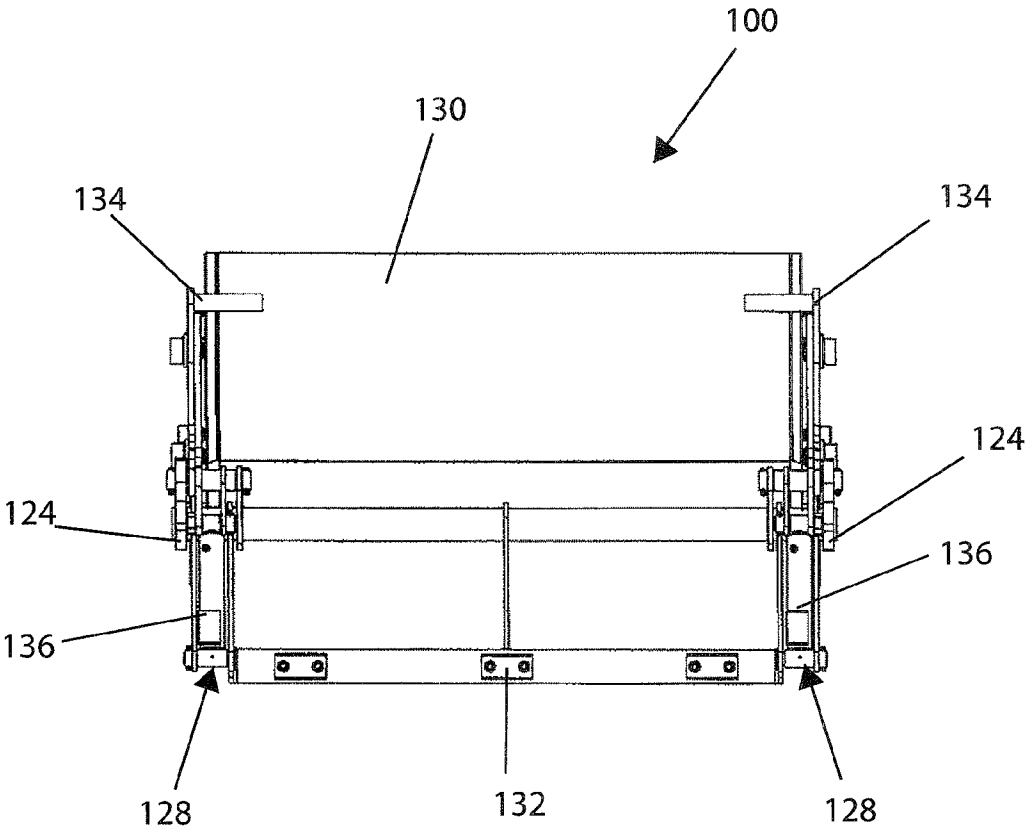
FIG. 9 is a front view of the adapter of FIG. 8.

Referring to FIGS. 8-10, the adapter 100 is shown separately from lift mechanism 102 and vehicle 1. When it is desirable to collect and empty a rear load container 104, adapter 100 is replaceably attached to lift mechanism 102. As described above, lift arms 111 are replaceably bolted to receptacles 113 on respective trunnion pocket members 124 of adapter 100. Carriage track rollers 110*a*, 110*b* are positioned within tracks 112. Side loaded refuse collection vehicle 1 is now ready for receiving rear loaded trunnion style containers.

In a first embodiment, adapter 100 is more specifically described as follows. Trunnion pocket members 124 are positioned on opposing sides of adapter 100 to locate and securely cradle the trunnions 126, 127 on container 104 in curved pockets 124*a* of trunnion pocket members 124. A stabilizer 128 abuts front wall 44 of container 104 when it is attached to adapter 100 and includes rubber bumpers 132 to support and hold the front wall 44 of container 104 as it is lifted between the respective positions. In the embodiment seen in FIGS. 6 and 7, a pair of lock arms 134 are powered by drivers 136 to rotate lock arms 134 down on the top of container 104 to securely clamp container 104 between lock arms 134 and stabilizer 128. Lock arms 134 rotate about an axis to the clamped position and extend from the axis to engage the top rim of container 104. At the end of each lock arm 134 is a bar member 22 that extends toward the inside of container 104 to ensure container 104 does not fall when lifted to the inverted position. Lift mechanism 102 can now lift a rear loaded trunnion style container 104 by its trunnions 126, 127 between the inverted unloading position and the initial ground position.

In a second embodiment according to the present invention as seen in FIGS. 1A, 11-13, adapter 100 includes members similar to the first embodiment of FIGS. 1, 2, and 3 with a few exceptions. Trunnion pocket members 124 are positioned on opposing sides of adapter 100 to locate and securely cradle the trunnions 126, 127 on container 104 in curved pockets 124*a* of trunnion pocket members 124. When container 104 is physically engaged by adapter 100 as it shifts outward from the collection body 1, stabilizer 128 (which includes elastomeric bumpers 132 thereon) abuts front wall 40 of container 104 as container 104 attaches to adapter 100 as adapter 100 is raised to place trunnions 126, 127 into trunnions pocket members 124. Stabilizer 128 may be driven forward toward container 104 by a drive cylinder such that stabilizer 128 may be rotated around axle 131 toward the front wall 40 (See FIG. 5) of container 104. This function is required when a container 104 is provided with a sloped front wall 40 such that the container 104 is substantially wider at the top than at the bottom. Stabilizer 128 is therefore moved from a generally vertical, rest position into abutment with the front wall 40 of the container 104 so that the container 104 will remain upright as it is lifted and then will rotate around the top corner of the compaction chamber 106 to the tipped, dumping position.

Stabilizer 128 forces container 104 to tip as lift arms 102 pull container over the upper parts 112*c* of rails 112. Stop arms 135 are powered by drivers 136 to rotate stop arms 135 downward toward and slightly above the top of container 104. In the lowered position, stop arms 134 overlie the open tops of the trunnion pockets 124*a* so that the trunnions 126, 127 are retained in the pockets 124*a*. At the end of each stop arm 135 is a segmented bar member 123 that extends generally toward the other segmented bar member 123 extending from the opposing stop arm 135 to ensure container 104 does not fall from the adapter 100 when lifted to the inverted position. Stop arms 135 rotate about an axis to the lowered position and extend from the axis to allow bar members 123 to overlie or to touchingly engage the top rim of container 104. Substantially horizontal segments 137 of bar members 123 overlie the top edges 46, 47 of the sides 44, 45 of container 104, and bar members 123 stop rotation of the container 104 by abutting the top edges 46, 47 when the container 104 is tipped while the non-coaxial extensions 139 extending from horizontal segments 137 permit the lids 43 of the container 104 to drop past the bar members 123 as the container 104 falls toward the load opening and is stopped by bar members 123.

With the stop arms 135 lowered, lift mechanism 102 can now lift a rear loaded trunnion style container 104 by its trunnions 126, 127 between the inverted unloading position and the initial ground position.

Figures 11, 12, 13:
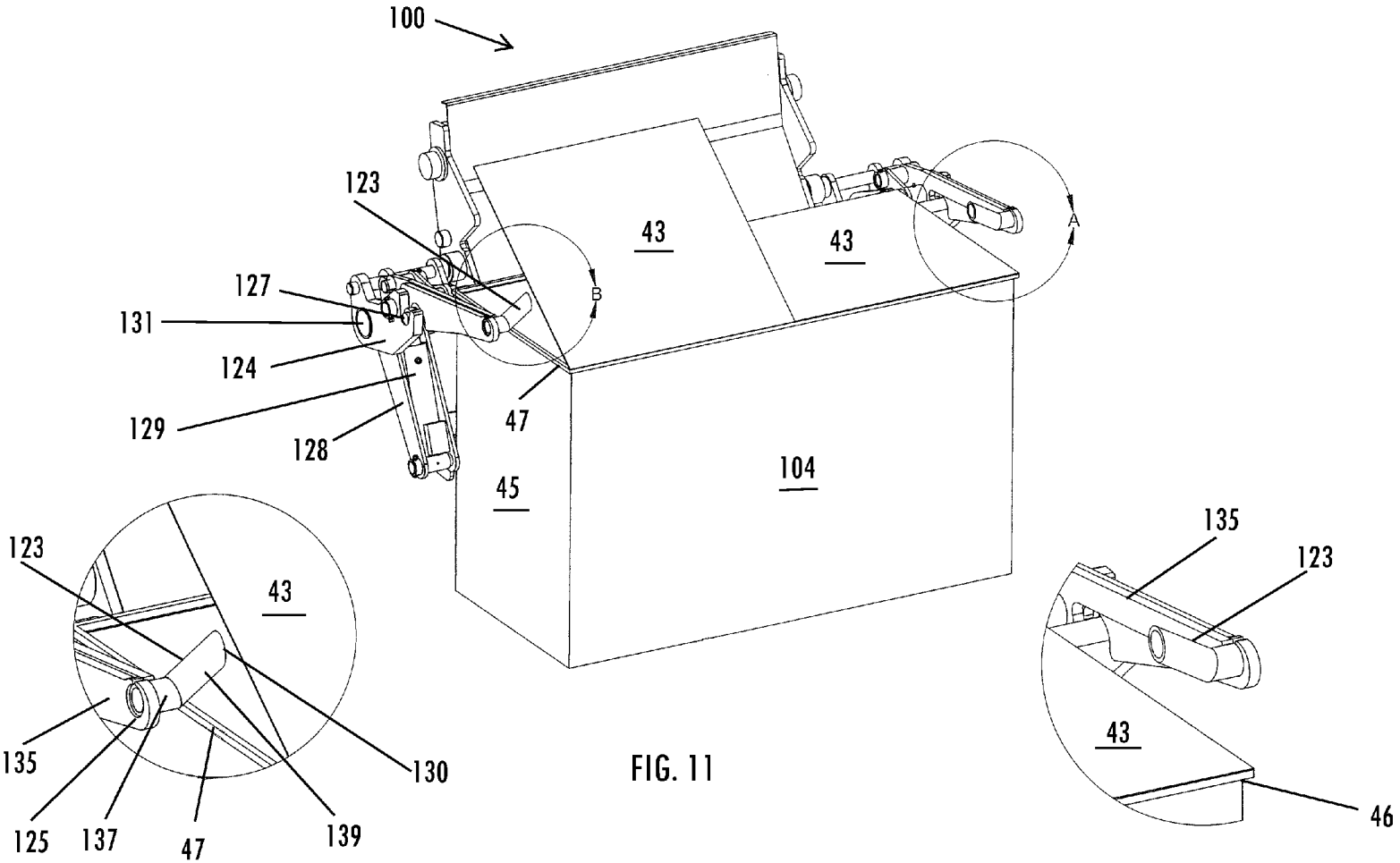
FIG. 11 is a perspective view of the second embodiment adapter of the present invention showing the adapter mechanism with lock arms having an angled bar element positioned above a top edge of a container.
FIG. 12 is an enlarged view of portions of the lock arm and container isolated in circled region A of FIG. 11, illustrating the container with a closed lid.
FIG. 13 is an enlarged view of portions of the lock arm and container isolated in circled region B of FIG. 11, illustrating the container with a raised lid.
Figure 14:
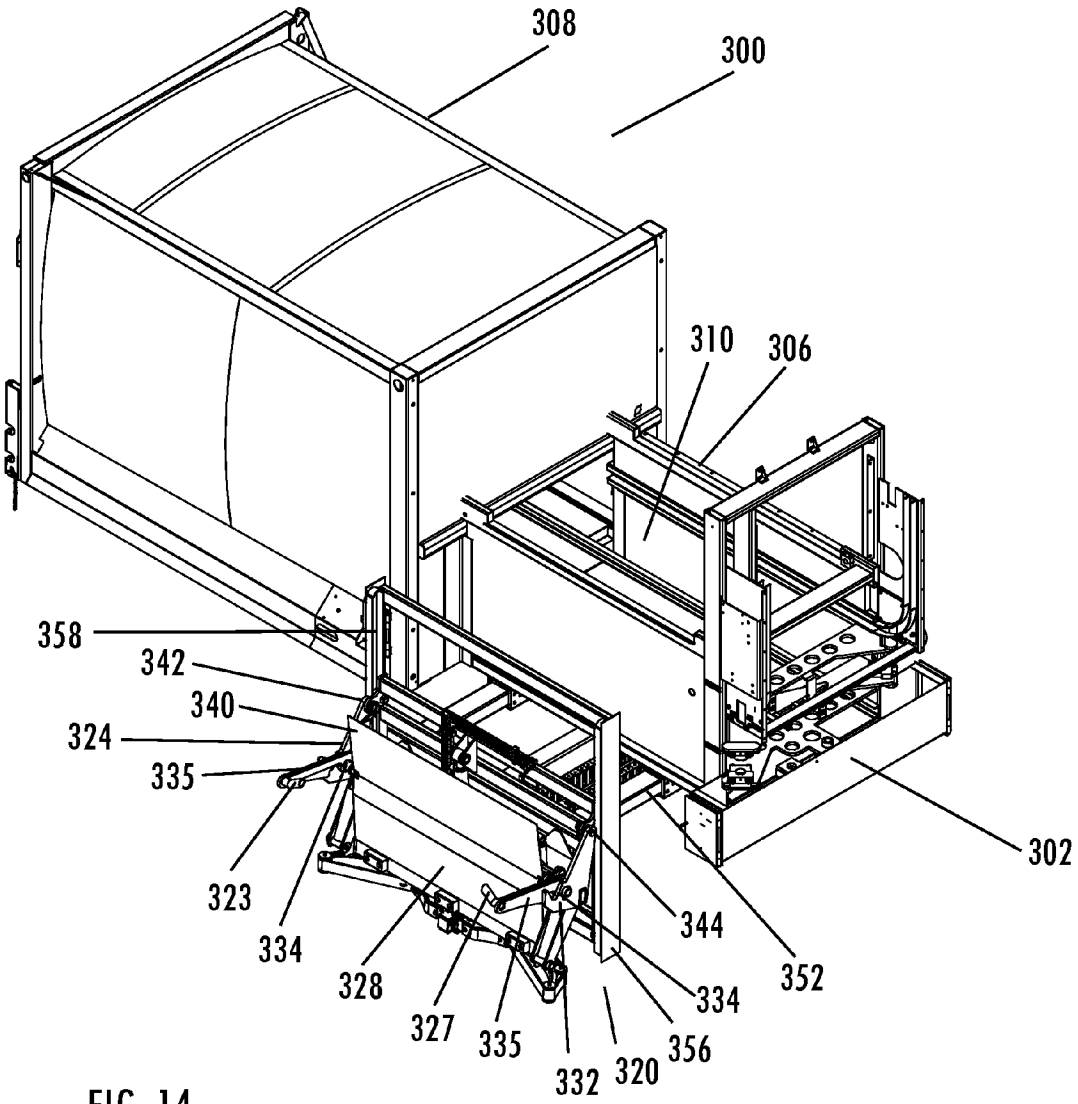
FIG. 14 is a perspective of a refuse collection body equipped with a side loading apparatus supported on a slide out carriage, the side loading apparatus shown in the lowered and extended position and capable of latching to a rear end loading container or an upright refuse bin.
Figure 15:
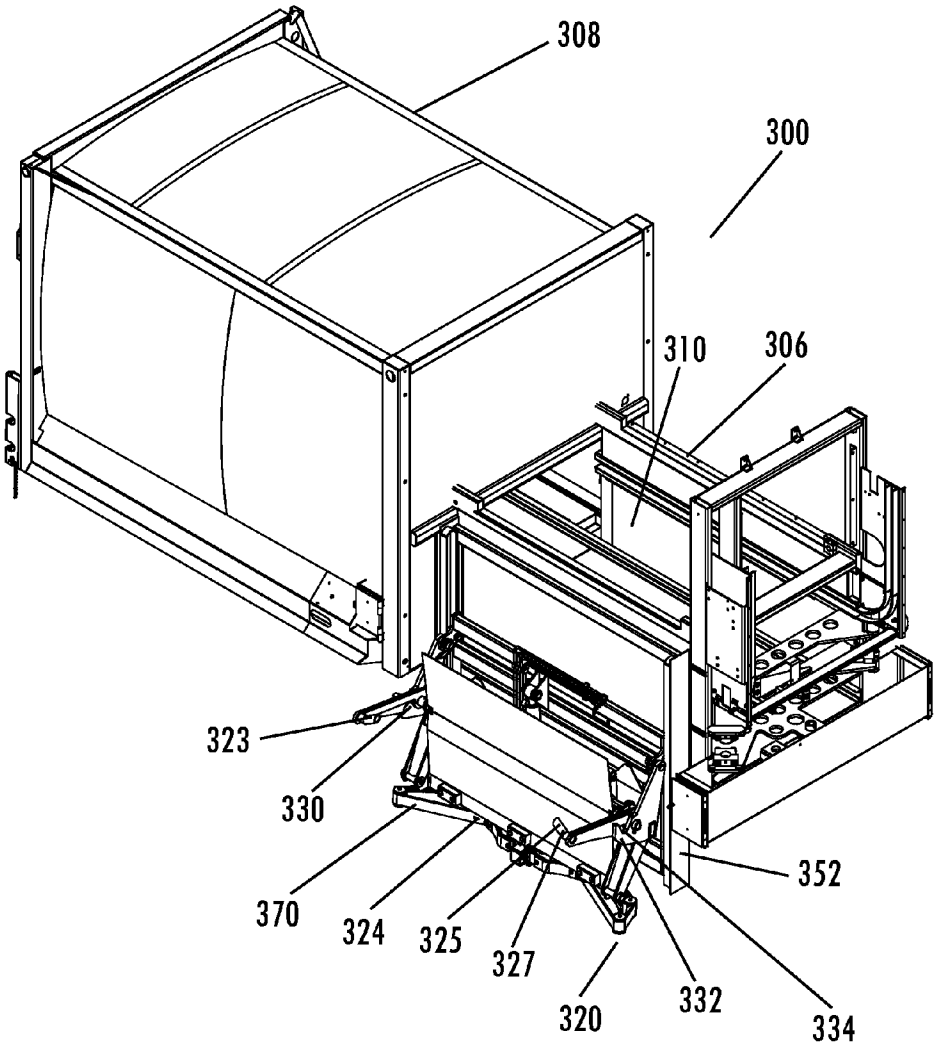
FIG. 15 is a perspective of the refuse collection body of FIG. 14 shown with the loading apparatus and carriage retracted and the loading apparatus in the lowered position.
Figure 17:
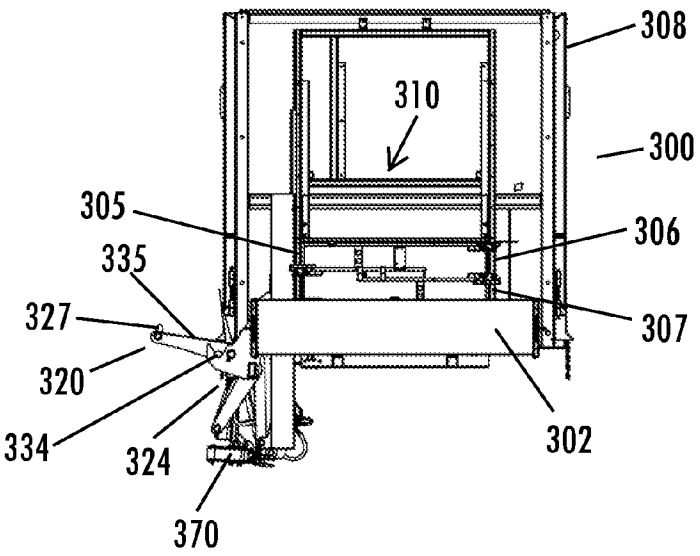
FIG. 17 is a front end view of the refuse collection body of FIG. 15.
Figure 16:
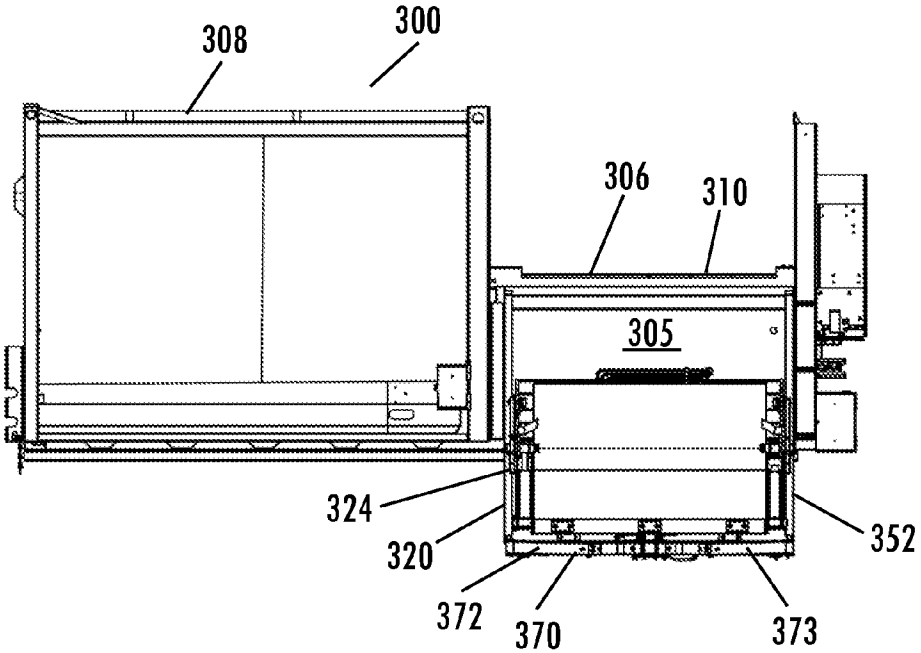
FIG. 16 is a side view of the refuse collection body of FIG. 15.

Referring specifically to FIGS. 1A and 11-13, each stop arm 135 has a bar element 123 extending noncoaxially therefrom to overlie one of the top edges 46, 47 of the end walls 44, 45 of container 104 to ensure that container 104 does not fall from adapter 100 when lifted and tipped to the inverted position. Each bar member 123 extends generally laterally toward the inside of container 104, from each stop arm 135, at or near the free end 125 thereof, such that each bar member 123 generally extends toward the other bar member 123 and across a top edge 46, 47 of end walls 44, 45 of container 104 a sufficient distance to prevent container 104 from falling into the load opening of compaction chamber 106. For a container 104 having front and rear walls 40, 42 which are about sixty to sixty-two inches long, bar members 123 may be six to ten inches long, preferably seven to eight inches long. For the typical container 104 which has flexible lids 43, particularly flexible plastic lids 43, bar member 123 permits the flexible lids 43 to flex and thereby pass by the free ends 130 of bar members 123 when container 104 is upended. As shown in FIGS. 11-13, each bar member 123 may include a first proximal segment 137 extending substantially noncoaxially from the stop arm 135 near the free end 125 thereof. Preferably, first segment 137 is substantially perpendicular to the longitudinal axis of stop arm 135. Each bar member 123 further includes a distal second segment 139 which is non-coaxial with first segment 137 and terminates in free end 130 of bar member 123. The angle of each second segment 139 of each bar element 123 in reference to a perpendicular to the longitudinal axis of stop arm 135 is approximately fifteen to forty degrees, and preferably about twenty-five to thirty-five degrees. Distal second segments 139 incline from horizontal when adapter 100 is in its lowered position and stop arms 135 are also in the lowered position. Optionally, bar members 123 may comprise a single curved segment extending from stop arm 135 with free end 130 inclined at about fifteen to forty degrees from a perpendicular to the longitudinal axis of the stop arm 135. Free end 130 is truncated vertically.

FIG. 12 is a close-up view of stop arm 135 in the lowered position with bar member 123 above a closed lid 43 of container 104. Each bar member 123 is positioned to overlie a top edge 46, 47 of an end wall 44, 45 sufficiently to stop container 104 from overrotating or falling into compaction chamber 106 yet the truncated length and inclining angle of angled distal second segment 139 of bar element 123 will allow lid 43 to flex and pass by bar member 123 as container 104 is inverted, thereby allowing commodity in container 104 to fall into compaction compartment 106. First segment 137 may extend perpendicularly from stop arm 135 in a range of about one to three inches, preferably about two inches, with second segment 139 inclining from first segment 137 and being approximately three to six inches long, preferably about four to five inches long. Because lid 43 is typically a plastic item, flexure is easy such that lid 43 will bend enough to pass by free end 130 of bar element 123.

To gain more perspective of adapter 100, referring back to FIG. 1, adapter 100 is assembled on a side loader collection vehicle 1 with stabilizer 128 abutting container 104 and lock arms 134 powered down toward the top of container 104 by a driver 136, which is a hydraulic cylinder 136 in the illustrative embodiment, thereby positioning container 104 between lock arms 134 and stabilizer 128 in the ground pick-up position. FIG. 3 shows the perspective of adapter 100 with container 104 rotated to an inverted unloading position.

Figure 7:
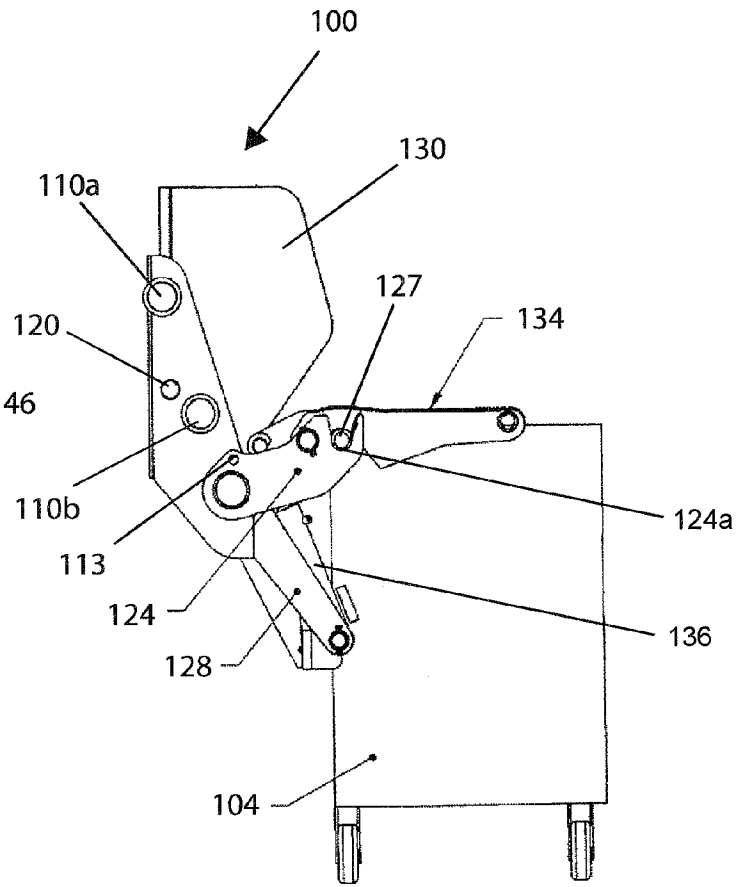
FIG. 7 is a side view of the adapter of FIG. 6.
Figure 6:
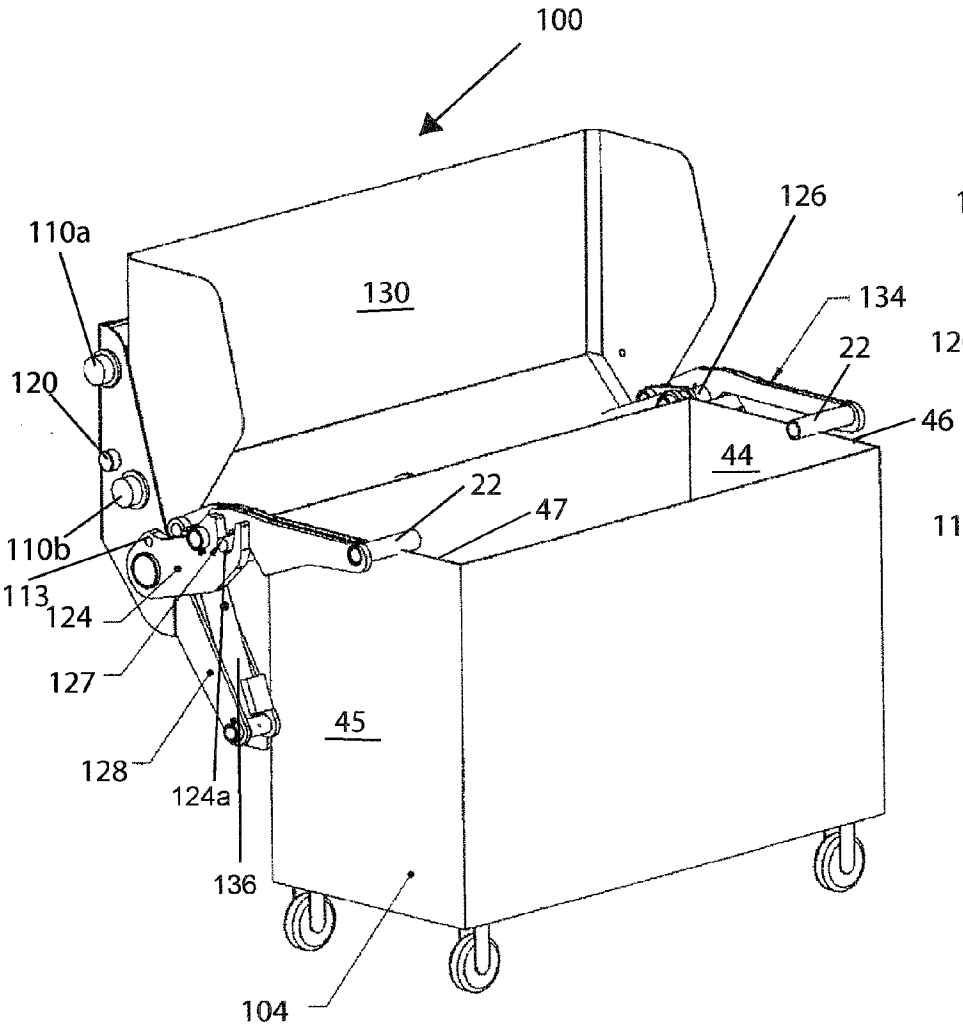
FIG. 6 is a perspective view of the first embodiment adapter of the present invention showing the adapter closed or clamped on a container.

In further detail, referring back to FIGS. 4 and 5, container 104 is shown combined with adapter 100 and with lock arms 134 in the open position. Adapter 100 is positioned at an appropriate distance from the ground to either extend outward to container 104 or enable container 104 to be rolled up alongside adapter 100. Adapter 100 and container 104 are oriented with trunnions 126, 127 of container 104 generally aligned slightly above trunnion pocket members 124 of adapter 100. Lock arms 134 are powered down toward the top of container 104 to prevent container 104 from falling while in the inverted position. Stabilizer 128 of adapter 100, as shown in FIGS. 6 and 7, abuts front wall 40 of container 104 to tip container 104 inward toward load opening 26 of compaction chamber 106 of vehicle 1 to empty its contents thereinto.

As container 104 rotates on adapter 100 to its tipped unloading position, container 104 will shift slightly to fall against the bar members 123 of arms 135 while the lid 43 will flex and slip past the bar member 123 adjacent thereto.

As may be understood from the illustrated embodiments shown in FIGS. 1A and 11-13, adapter 100 allows a rear end load container 104 to be removed from rest and emptied into load opening 26 without manipulation by an operator who may control the cylinders 140 to cause lift mechanism 102 to reach out and grasp container 104 and then to lift container 104 to its tipped position above load opening 26 such that lids 43 of container 104 may fall free of stop arms 135 while container 104 abuts bar members 123 and is restrained from over-rotating or falling from adapter 100 into the load opening 26.

FIGS. 14-18 disclose another embodiment of the invention 320 which mounts to a side loading refuse collection body 300. Collection body 300 includes a compaction chamber 306 forward of a storage compartment 308. Refuse commodities like household or industrial waste or recyclables like aluminum cans, other metal items, plastics, paper products, yard waste or other materials may be loaded into load opening 310 at the top of compaction chamber 306. Once within compaction chamber 306, the commodity may be compacted and transferred into the storage compartment 308.

Referring particularly to FIGS. 14-17, it is seen that invention 320 comprises a linearly displaceable slide out carriage 352 which supports a commodity loading mechanism 324 adapted to connect to a trunnion equipped rear end load type container or alternatively to an upright refuse bin. Carriage 252 with loading mechanism 324 may be provided at either or both opposing lateral sides 305, 307 of compaction chamber 306 such that commodity in a trunnion equipped refuse container 104 (See FIG. 1-7) may be loaded into load opening 310 from either side 305, 307 of compaction chamber 306. Carriage 352 may be selectively moved transversely to the longitudinal axis of collection body 300 and laterally to the compaction chamber 306. Therefore, carriage 352 may move loading mechanism 324 outward so as to reach a container 104 situated at a distance from refuse body 300.

Carriage 352 includes upright frame 356 which supports opposing guide channels 358, 359 along which loading mechanism 324 can travel. Carriage 352 includes rails 357 which extend below and are supported by and under the frame 302 of body 300.

Loading mechanism 324 comprises a pair of spaced apart container lift arms 330, 332 each of which includes a trunnion pocket 334. Container lift arms 330, 332 are spaced apart slightly more than the length, that is, approximately 60 inches to 62 inches, of a standard trunnion equipped refuse container, such as container 104 illustrated in FIGS. 1-2, 4-7 and 11. Referring back to FIG. 4, a standard trunnion equipped rear load container includes trunnions 126, 127 which extend from opposing ends 44, 45 of container 104. When such a container 104 is located alongside unloading mechanism 324, the trunnions 126, 127 may be received in trunnion pockets 334 of load mechanism 324. Then stop arms 335 may be pivoted into their lowered position with the bar members 323 of stop arms 335 positioned over the top edges 46, 47 of container end walls 43, 45. In the lowered position, stop arms 135 overlie the open tops of the trunnion pockets 334 so that the trunnions 126, 127 are retained in the pockets 334. Stop arms 335 are driven by hydraulic cylinders.

Bar members 323 generally extend laterally from stop arms 335 so they will overlie the top edges 46, 47 of the container 104. Because each bar member 323 includes an upwardly angled free ended segment 325, a lid 43 of a refuse container 104 will flex and fall open past bar members 323 when the container 104 is upended, while the attached segment 327 of each bar member 323 will clamp container 104 to stabilizer plate 328. Stabilizer plate 328 may be pivoted forward toward the container 104 to securely compress the container 104 between stop arms 335 and stabilizer plate 328.

A guide plate 340 extends above the stabilizer plate 328 to provide a guide for commodity falling from container 104 when it is upended. Below stabilizer plate 328, a grapple mechanism 370 may be mounted to loading mechanism 324 such that the arms 372, 373 of the grapple mechanism 370 may be operated to wrap around a twenty to fifty gallon upright refuse bin when such a commodity containing container is to be emptied into compaction chamber 306.

Regardless whether a rear end load container 104 or an upright refuse bin is retained to unloading mechanism 324, the carriage 352 may be retracted toward the refuse collection body 300 by a driver member (preferably a hydraulic cylinder) and then loading mechanism 324 may be moved upward along channels 358, 359 of frame 326. The container retained to loading mechanism 324 can then be emptied by rotating the loading mechanism 324 around axles 342, 344 carried on frame 333 of loading mechanism 324, the axles 342, 344 being elevated with loading mechanism 324 along frame 356 when unloading of the container 104 is to be accomplished.

Figure 18:
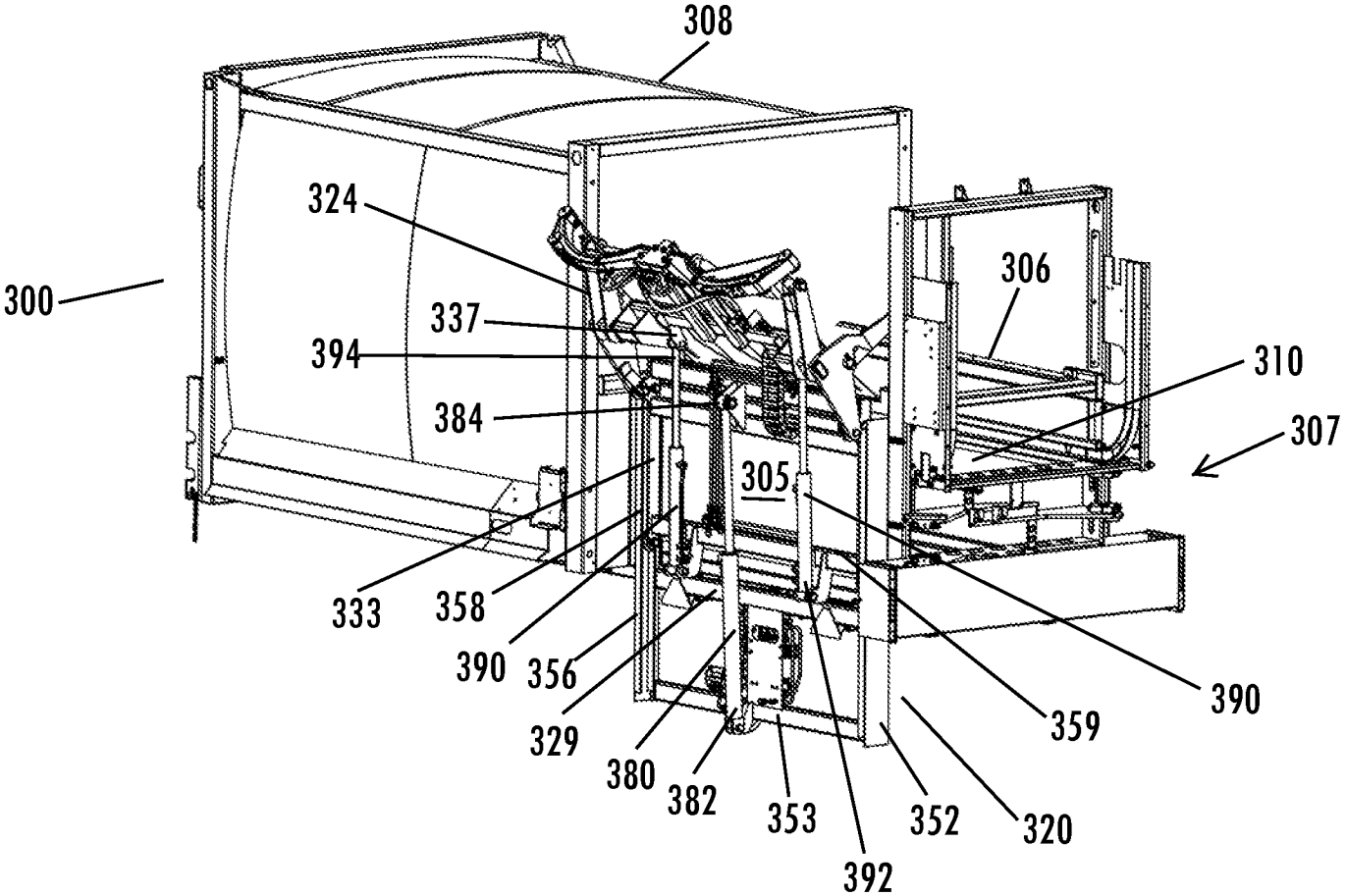
FIG. 18 is a perspective of the refuse collection body of FIG. 14 shown with the carriage retracted and with the unloading apparatus raised and upended.

Referring now additionally to FIG. 18, it may be observed that central cylinder 380 which is mounted at its base 382 to lower beam 353 of carriage frame 356 and at its rod end 384 to the unloading mechanism 324 may selectively elevate the unloading mechanism 324 to the top of carriage frame 356 whereupon tip cylinder(s) 390 may be extended to upend the loading mechanism 324 over the load opening 310. The base 392 of each tip cylinder 390 is hinged to the lower horizontal beam 353 of frame 356 of unloading mechanism 324 while rod ends 394 of each tip cylinder 390 are hinged to vertical frame members 337 of the unloading mechanism 324.

It should be now clearly understood that the invention 320 can be remotely operated to (a) extend toward a standard trunnion equipped commodity container, (b) then locate the trunnions extending from the ends of the rear end load container into pockets 334, (c) then rotate stop arms 335 to a lower position over the top edges of the trunnion equipped container, (d) then pull the latched container toward the side of the compaction chamber, and (e) then raise the latched container alongside the compaction chamber and upend it to dump its contents into the compaction chamber, while preventing the container from over-rotating about its trunnions or dropping from its attachment to the loading mechanism of the invention. After the container has been emptied, the invention will lower the container to the ground level and return it to its starting position displaced from the refuse body, release the container, and retract to its rest position alongside the frame of the commodity collection body. Therefore, a rear end load container sitting at the side of a roadway may be emptied into a side loading commodity collection body equipped with the invention by an operator who may not need to leave the cab of the truck on which the collection body is mounted.

Various aspects of any of the embodiments can be combined in different combinations than the ones shown to create new embodiments that fall within the scope of the appended claims.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising".

What is claimed is:

1. A side loading mechanism for a commodity collection body having a compaction chamber forward of a storage compartment and a lifting mechanism adjacent a lateral side of the compaction chamber, the side loading mechanism comprising:

a pair of spaced apart trunnion pocket members, the trunnion pocket members movable in a substantially vertical direction, each trunnion pocket member including a trunnion pocket thereon, a pair of arms selectively rotatable about an axis, each arm rotatable between a first position and a second position, each arm including a bar member extending substantially noncoaxially therefrom, each bar member extending generally toward the other bar member when both arms are in the second position, each bar member inclining from horizontal when the arm is in the second position and the lifting mechanism is in a lowered position, the lifting mechanism joined to the trunnion pocket members, the lifting mechanism operable to elevate the trunnion pocket members from a lowered position to an elevated position at or above a loading opening of the collection body, a stabilizer extending below the trunnion pocket members when the lift mechanism is in the lowered position, the trunnion pockets selectively receive respective trunnions extending from opposing ends of a rear loading commodity container, each bar member overlying a top of an opposing end wall of the rear loading commodity container when the arms are moved to the second position, each bar member spaced a small distance from the top of the respective end wall when the arms are in the second position and the lifting mechanism is in the lowered position, the stabilizer urging a front wall of the rear loading commodity container to rotate about an axis defined by the trunnions when the trunnion pocket members are elevated to the position at or above the loading opening of the collection body, the bar members abutting the tops of the opposing end walls of the rear loading commodity container when the rear loading refuse container is substantially upended, preventing the trunnions of the real loading commodity container from falling from the trunnion pockets.

2. The side loading mechanism of claim 1 further comprising a guide member extending above the stabilizer and disposed between the arms, the guide member generally aligned with the front wall of the rear loading commodity container when trunnions of the rear loading commodity container are received in pockets of the trunnion pocket members.

3. The side loading mechanism of claim 2 wherein the stabilizer abuts the front wall of the rear loading commodity container when the lift mechanism rises above the lowered position, each bar member comprises a first segment joined to the arm and a second segment extending non coaxially from the first segment, the arms are sufficiently truncated to permit flexible lids hinged to the rear loading container to fall past free ends of the arms when the rear loading commodity container is upended over the loading opening.

4. Apparatus to unload a trunnion equipped refuse container into a commodity collection body, the refuse container having opposing front and back walls and opposing end walls, with trunnion bars extending from the end walls of the container at a top of the front wall thereof, the invention comprising:

a frame adapted to be lifted from a lowered position to an elevated position adjacent a load opening of the refuse collection body, spaced apart trunnion pockets supported on the frame, pivot arms pivotable upon the frame, each pivot arm being selectively pivotable between a raised position and a lowered position, each pivot arm disposed in general vertical alignment with one of the trunnion pockets, each pivot arm having a hinge end and a free end, a bar member extending substantially noncoaxially from each pivot arm, the bar member spaced apart from the hinge end of the pivot arm, each bar member extending generally toward the other bar member, each bar member inclining from horizontal when the pivot arm is in the lowered position and the frame is in the lowered position, lift apparatus joined to the frame to lift the frame to the elevated position, each bar member comprises a first segment and a second segment, the first segment joined to the pivot arm at a substantial perpendicular, the second segment extending noncoaxially from the first segment, the second segment extends from the first segment at from fifteen to forty degrees from a longitudinal axis of the first segment, each trunnion includes rollers thereon, the rollers engaging tracks disposed alongside the commodity collection body.

5. In a commodity collection vehicle having a collection body, the collection body having a load opening at a top thereof and further having a lift assembly combined to a lateral side of the collection body, an adapter for removable attachment to the lift assembly comprising:

spaced apart pocket members supported on a frame, open topped pockets disposed on each pocket member, pivotable arms pivotable upon the frame, each pivotable arm being selectively pivotable between a raised position and a lowered position, each pivotable arm disposed proximate to a one of the pocket members, each pivotable arm having a hinge end and a free end, a bar member extending substantially noncoaxially from each pivotable arm, the bar member spaced apart from the hinge end of the pivotable arm, each bar member extending generally toward the other bar member, each bar member inclining from horizontal when the pivotable arm is in the lowered position and the assembly is in the lower position, wherein the pockets may receive trunnions extending from opposing ends of a trunnion equipped container, the bar members are disposed overlying top edges of the opposing end walls when the pivotable arms are in the lowered position, the bar members abutting the top edges of the opposing end walls of the container when the container is elevated and substantially tipped over the load opening.

6. A side loading commodity collection body comprising a compaction chamber adjacent to and forward of a storage compartment, the compaction chamber having a load opening at a top thereof, a lifting mechanism operable along a lateral side of the compaction chamber, the lifting mechanism movable between a lowered position and a raised position, an adapter selectively combinable to the lifting mechanism, the adapter comprising a pair of spaced apart trunnion pocket members, each trunnion pocket member having an open topped trunnion pocket thereon, a lock arm pivotable upon each of the pocket members, each lock arm being selectively pivotable between a raised position and a lowered position, each lock arm disposed in general alignment with one of the trunnion pockets, each lock arm having a hinge end and a free end, a bar member extending substantially noncoaxially from each lock arm, the bar member spaced apart from the hinge end of the lock arm, each bar member extending generally toward the other bar member along the length of the bar members, each bar member inclining from horizontal when the lock arm is in the lowered position and the lifting mechanism is in the lowered position.

7. The commodity collection body of claim 6 further comprising a carriage selectively movable transversely relative to a longitudinal axis of the collection body from a fully extended position to a retracted position, the lifting mechanism carried on the carriage, the lifting mechanism adapted for removable retention of a trunnion equipped container thereto, the trunnion equipped container including trunnions extending from opposite ends thereof, the trunnions selectively receivable in the trunnion pockets, the lifting mechanism movable substantially vertically along an upright frame of the carriage.

8. The commodity collection body of claim 7 wherein the lifting mechanism further includes a supporting plate for abutment to a first side of the trunnion equipped refuse container while said trunnion equipped refuse container is retained to the adapter, a first driver for elevating the lifting mechanism vertically along the frame of the carriage, a second driver for pivoting the lifting mechanism about pivot axles thereon to raise the supporting plate above the stop arms in the lowered position, a third driver for extending and retracting the carriage from the compaction compartment, the lifting mechanism movable substantially vertically along the carriage, a first driver for selectively elevating the lifting mechanism vertically along a side of the compaction compartment, the lifting mechanism rotating the trunnion equipped container into its dumping position over the intake opening of the commodity collection body, a second driver for selectively extending and retracting the carriage from the compaction compartment.

9. The collection body of claim 6 wherein the adapter further comprises a link between the pair of lock arms, the link combined to the pair of lock arms to synchronize the movement of the pair of lock arms.

10. The collection body of claim 6 further comprising a track extending up the side of the compaction chamber to provide a path of travel, the adapter further comprises a pair of track rollers spaced apart to align with the track, wherein the adapter is replaceably attached to the collection body with the track rollers engaged in the track to guide the adapter between the loading position and the inverted unloading position.

11. The collection body of claim 10, wherein the lock arms are combinable to the trunnion pockets on opposing sides of the adapter to move the adapter between the loading position and the inverted unloading position, and the adapter further comprises:

a stabilizer replaceably positionable against a front of the container to hold the container in position and prevent the container from rotating about the trunnions when the container is lifted between the loading position and the inverted unloading position;

a driver combined with the stabilizer and having a rod combined with the pair of lock arms to move the pair of lock arms to the locked position with the container held firmly between the stabilizer and the pair of lock arms to secure the container as it is lifted between the loading position and the inverted unloading position; and a guide plate combined with the stabilizer and extending between the pair of trunnion pockets to prevent refuse from falling outside of the chamber when the container is in the inverted unloading position.

12. A mechanism to engage a refuse container having trunnions extending from opposing end walls thereof, the mechanism comprising a pair of spaced apart trunnion receiving members, each of the trunnion receiving members including an open topped trunnion pocket for removably receiving one of the trunnions of the refuse container therein, the mechanism further including a pair of arms, each arm selectively pivotable between a raised position and a lowered position, each arm in the lowered position generally overlying a one of the trunnion receiving members, the mechanism further including a stabilizer for abutment to a first side of the refuse container, the stabilizer abutting the first side of the refuse container while said refuse container is lifted by the mechanism, each of the arms comprising a bar element extending therefrom, each bar element having a free end, the bar element of each arm extending generally laterally from the arm into a space between the arms, the bar element of each arm inclining from horizontal when the arm is in the lowered position, each bar element overlying a top edge of a respective one of the end walls of the refuse container when trunnions of the refuse container are positioned in the trunnion pockets and the arms are pivoted to the lowered position, each bar element abutting the top edge of one of the end walls when the refuse container is substantially tipped to a dumping position.

13. The mechanism of claim 12 wherein each bar element includes a first portion joined to the arm and extending substantially perpendicularly therefrom, each bar element further including a second portion noncoaxial with the first portion thereof, the second portion of each bar element extending away from the respective top edge of the one of the end walls of the refuse container, the first portion of each bar element abutting the respective top edge of the end wall when the refuse container is tipped to the dumping position, the bar element of each member sufficiently truncated in length to allow a hinged flexible lid on the refuse container to pass by the free end of each bar element when the refuse container is tipped to the dumping position.

14. An automated side loading mechanism for a commodity collection body mounted on a truck chassis, the invention comprising:

a carriage selectively movable transversely relative to a longitudinal axis of the collection body from a fully extended position to a retracted position, a lifting mechanism carried on the carriage, the lifting mechanism adapted for selective retention of a trunnion equipped container thereto, the trunnion equipped container including trunnions extending from opposite ends thereof, the lifting mechanism movable substantially vertically along the carriage, the lifting mechanism including a pair of spaced apart trunnion receiving members, each of the trunnion receiving members including an open topped trunnion pocket thereon for removably receiving one of the trunnions of the trunnion equipped container therein, the lifting mechanism further including a pair of arms pivotable thereon, each arm pivotable between a raised position and a lowered position, each arm selectively pivotable to the lowered position wherein an element on the arm overlies a top of a respective one of end walls of the trunnion equipped container when trunnions of the trunnion equipped container are positioned in the trunnion pockets, the element on each arm abutting the top of one of the end walls when the trunnion equipped container is substantially tipped to a dumping position overlying an intake opening of the commodity collection body, a bar member extending substantially noncoaxially from each arm, the bar member spaced apart from the hinge end of the arm, each bar member extending generally toward the other bar member along the length of the bar members, the lifting mechanism further including a stabilizer for abutment to a first side of the trunnion equipped container while said trunnion equipped container is retained to the lifting mechanism, a first driver for selectively elevating the lifting mechanism vertically along a side of a compaction compartment of the commodity collection body, the lifting mechanism rotating the trunnion equipped container into its dumping position over the intake opening of the commodity collection body, a second driver for selectively extending and retracting the carriage from the commodity collection body.

* * * * *